US007364462B2

(12) United States Patent
Holland

(10) Patent No.: US 7,364,462 B2
(45) Date of Patent: Apr. 29, 2008

(54) COMPRESSION RING FOR COAXIAL CABLE CONNECTOR

(76) Inventor: Michael Holland, 107 Via Del Cielo, Santa Barbara, CA (US) 93109

( * ) Notice: Subject to any disclaimer, the term of this patent is extended or adjusted under 35 U.S.C. 154(b) by 73 days.

(21) Appl. No.: 11/591,690

(22) Filed: Nov. 1, 2006

(65) Prior Publication Data

US 2007/0259565 A1 Nov. 8, 2007

Related U.S. Application Data

(60) Provisional application No. 60/842,994, filed on Sep. 6, 2006, provisional application No. 60/797,322, filed on May 2, 2006.

(51) Int. Cl.
*H01R 21/20* (2006.01)

(52) U.S. Cl. ..... 439/584; 439/578; 439/585

(58) Field of Classification Search ..... 439/578, 439/583–585

See application file for complete search history.

(56) References Cited

U.S. PATENT DOCUMENTS

| | | | | |
|---|---|---|---|---|
| 3,744,007 | A * | 7/1973 | Horak | 439/394 |
| 6,530,807 | B2 * | 3/2003 | Rodrigues et al. | 439/578 |
| 7,018,235 | B1 * | 3/2006 | Burris et al. | 439/584 |
| 7,252,546 | B1 * | 8/2007 | Holland | 439/584 |
| 2005/0079761 | A1 * | 4/2005 | Rodrigues | 439/578 |
| 2005/0170693 | A1 * | 8/2005 | Wild | 439/578 |
| 2006/0014426 | A1 * | 1/2006 | Montena | 439/578 |
| 2006/0128217 | A1 * | 6/2006 | Burris | 439/584 |
| 2006/0292926 | A1 * | 12/2006 | Chee et al. | 439/584 |
| 2007/0042642 | A1 * | 2/2007 | Montena et al. | 439/578 |
| 2007/0155233 | A1 * | 7/2007 | Laerke et al. | 439/578 |

* cited by examiner

*Primary Examiner*—Briggitte R. Hammond
*Assistant Examiner*—Larisa Tsukerman
(74) *Attorney, Agent, or Firm*—Laura Tunnell; Michael Petit

(57) ABSTRACT

The present invention discloses an improvement in coaxial compression connectors used in, inter alia, CATV, satellite, and home theater electronics. The present connectors accept a large range of cable sizes, allow replacement of the holding or compression element to accommodate a range of sizes, and allow the connector to be re-uesable. The connector comprises an attachment nut operable for electrically connecting the coaxial cable to another device, a tubular shank attached to the connector nut operable for accepting the dielectric layer of the coaxial cable therewithin, a body portion connecting the nut and tubular shank, a compression ring and an outer shell. In a first embodiment, the compression ring is a relatively short tubular member removably housed within the outer shell. The compression ring has an annular compression groove on the outer circumference thereof which causes a mid-portion of the ring to deform inwardly in response to a longitudinal force applied to opposing ends of the compression ring to securely hold the cable within the connector and create a 360 degree moisture seal. In a second embodiment, the body portion deforms inwardly. In both embodiments, a shoulder within the shell abuts the trailing end of the compressive member and exerts a longitudinal compression force thereon that causes the compressive member to circumferentially buckle inwardly against the cable.

6 Claims, 3 Drawing Sheets

COMPRESSION RING FOR COAXIAL CABLE CONNECTOR

This application claims the benefit of U.S. Provisional Applications Ser. No. 60/797,322, filed May 2, 2006, and Ser. No. 60/842,994, filed Sep. 6, 2006.

BACKGROUND OF THE INVENTION

1. Field of the Invention

The present invention relates to a deformable compression ring for use in a coaxial cable connector.

2. Prior Art

The plethora of compression-type coaxial connectors in current use all have limitations with regard to accepting a restricted size range of cables and can only be used once. Some connectors have the ability to exchange parts to adjust for out-of-size cables. The present art designs are one-time use. Due to the expense of many gold plated and specialty connectors now used in home theater and wireless and industrial applications, re-useability is a desirable feature when an error is made during installation.

Burris, in U.S. Pat. No. 5,525,076, discloses a compression-type coaxial cable connector including an outer tubular member having an axial bore for receiving a coaxial cable, a free end, and an inner end. A coupling member is attached to the inner end of the outer tubular member for coupling the coaxial cable to a mating coaxial cable connector. A securement means is carried by the outer tubular member for providing mechanical, and sealing engagement with the coaxial cable in response to a longitudinal compressive force. The operability of the securement means relies upon the compression of the outer shell to deform a groove to protrude inwardly thus securing a coaxial cable between the inward protrusion and a center post. In operation, the connector disclosed in the '076 patent has problems.

The aforesaid '076 patent teaches the use of a groove in the outer shell that, when compressed longitudinally, results in an inward deformation of the groove forming a 360 degree reduced diameter seal over the coaxial cable jacket. U.S. Pat. No. 6,042,422 further enhances the method by using a unique groove design. Burris has the difficulty of manufacture in that the groove needs to be made to a high tolerance to insure uniform compression, and the entire body (which is made from metal) needs to be annealed to effect compression at the groove/weakened location. The compression element (i.e., the groove) needs to be machined into the thick metal comprising the body of the connector. Another limitation is that upon compression of the body, it must be compressed evenly or the connector will not close properly. The connector disclosed in the '076 patent has the problem of manufacturing precision grooves and consistent metal annealing to allow the longitudinally-moving shell to produce equal circumferenced inward protrusions. If the heat treating is not perfect, too much force will be required to compress the outer shell of the connector thus making it difficult to use. In addition, keeping the correct groove shape to have the protrusions move inwardly (versus collapse) is difficult. U.S. Pat. No. 6,042,422 acknowledges this problem and discloses a securement member that optimizes the metal shape of this groove.

The second problem with the compression-type connector disclosed in U.S. Pat. No. 5,525,076 is that the compression tools used to compress the securement member do not apply longitudinal force equally over the 360 degrees of the rear compression shell. For example, the compression tool may only apply a compressive force on 270 degrees. In such an event, the securement member may not collapse equally, resulting in only partial radial inward deformation. This effect is dependent upon the compression tool used and the craft skills of the user. It would be desirable to provide an improved securement member that will provide uniform compression of a cable around the circumference thereof.

Holland, in U.S. Pat. No. 7,008,263, teaches of an internal compression ring that is removable and replaceable to meet a new demand in the market. The limitation on the Holland design, where the ring is deformed in the rear only by a rear tapered shell ID, is that this bigger taper that is needed to compress the ring also restricts the maximum OD cable that may be used.

Montena teaches of an outer shell/fastener moving from an open/outer position to a closed one resulting in the sloping ID of the shell compressing the body radially inward at its rear. This has the limitations of having to also heat treat the entire body to effect a soft compression of the trailing edge. It is also being limited as a one-use, connector.

Sterling, in U.S. Pat. No. 6,848,939, uses a wedge plug that compresses the cable between the body and ferrule and is located remotely from under the body/

Burris, in U.S. Pat. No. 7,018,235, also begins with a compression ring remote from the body but differs from Sterling in that this ring's final position is over the center tube/ferrule rear end and exerts radial force for holding and sealing by forming an arc. This arc is formed by the longitudinal force and the chamfer on both the rear edge of the body and the front inside edge of the shell/fastener. The limitations of this design is that the force is very dependant upon the material of the ring being able to form an arc shape rather than assume the method of the Sterling. This material must be restricted in type.

Chee, in U.S. Pat. No. 6,817,897, uses an inner ring that is fixed and requires a series of shoulders that bend inward as a group to effect compression. This compression is effected by the rear taper of the fastener's inner surface as it moves laterally.

Most prior art connectors that employ removable compression rings require that at least a portion of the axial bore of the body portion or the shell (and/or the outer surface of the compression ring) be conically tapered to effect radial deformation of the compression ring during longitudinal compression of the connector. The present invention, by using a perpendicular edge (shoulder) on the ID of the axial bore of the shell to longitudinally compress the compression ring, enables a cable having a larger OD to be inserted into the axial bore of the compression ring. By moving the grooved compression ring to a position within the axial lumen of the outer shell, as in the present invention, the outer shell and the body acts as a guide to insure radially uniform inward deformation of the mid-portion of the ring and allows the use of different materials than the body or shell for making the rings. Rubber, plastic, or specially spiked surfaces can be used for such cables with hard jackets for burial or plenum cables adapted for use in potential fire areas.

SUMMARY

The present invention is directed to an improved compression ring for use in a compression-type coaxial cable connector that substantially obviates one or more of the limitations of the related art. To achieve these and other advantages and in accordance with the purpose of the invention, as embodied and broadly described herein, the invention includes a compression ring for insertion within the axial lumen of the outer shell of a compression-type coaxial cable connector, the general features and operation of the connector being well know in the art.

The present invention discloses an improvement in a coaxial cable connector comprising a connector nut, a tubular shank extending rearwardly from the connector nut, a tubular body portion concentrically overlying the tubular shank and a tubular outer shell having a central lumen slidingly attached to a trailing end of the body portion. The compression ring is removably disposed within the central lumen of the outer shell rearward of the trailing end of the body portion. The compression ring comprises a tubular member having a leading end, a trailing end and a circumferential annular groove on an outer surface thereof. The annular groove predisposes the midportion of the compression ring to deform radially inwardly when a longitudinal compressive force is applied to the compression ring. The annular groove is preferably disposed midway between the leading end and the trailing end of the compression ring.

More particularly, the compression ring of the present invention is a short tubular member having an axial lumen and an annular groove circumscribed around the outer surface thereof. The groove enables the radially inward deformation of the central portion of the axial lumen when a longitudinal compressive force is applied to the leading and trailing ends of the compression ring. The deformation of the ring over a cable forms a moisture-proof seal by the inward 360 degree ridge being formed by longitudinal force on the ring. The annular groove provides a pre-weakened portion to begin the deformation into a reduced ID circular ridge in the axial lumen. The material comprising the compression ring can be changed to support softer cables and harder ones. The ring closure method and seal differ from former ones by center-ring groove being forced to collapse into a seal by longitudinal force. Accordingly, it is unnecessary to include slots in the deformable compression ring to facilitate deformation. Such slots enable deformation of the compression member in response to a longitudinal force, but they do not provide a leakproof moisture seal. The present compression ring provides an annular mointure seal between the connector and the cable.

A second embodiment of the present invention is directed to an improved securement member wherein the body portion of the connector comprises a tubular plastic sleeve having an axial bore adapted to snugly accommodate a coaxial cable therewithin. The sleeve has a leading (forward) end that abuts the connector nut, a trailing (rearward) end and an elastically deformable body portion therebetween. The sleeve (i.e., body portion) has a plurality of annular grooves on an outer surface thereof. A rigid tubular shell having a uniform cylindrical axial bore and a recurved trailing end overlies the trailing end of the sleeve. When a coaxial cable is inserted through the axial bore of the sleeve to project through the leading end of the sleeve and the cable/sleeve assembly inserted into the coaxial cable connector such that the (barbed) centerpost (shank) of the connector is disposed between the conductive braided shielding and the dielectric layer of the cable, and the rigid shell is advanced over the sleeve toward the leading end of the sleeve by means of a compression tool, the longitudinal compression of the sleeve causes the sleeve to buckle radially inwardly in the region underlying the annular grooves and press against the cable jacket at select points. The deformable plastic sleeve obviates one or more of the limitations of the related art.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 1:
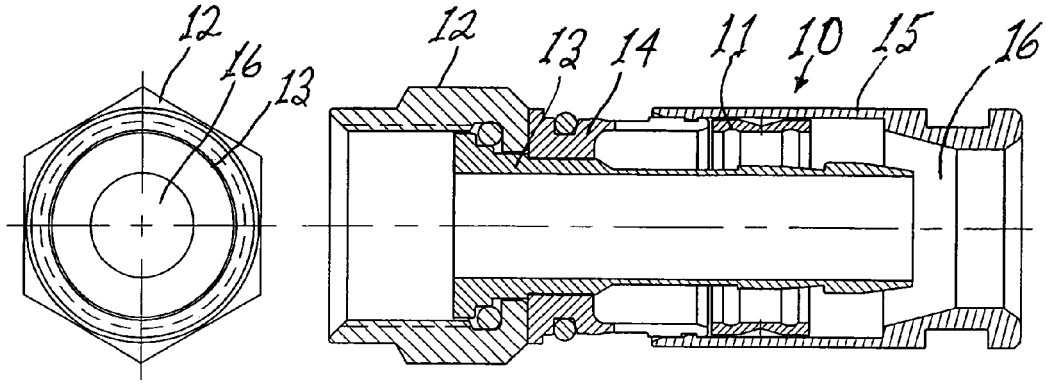
FIG. 1 is a longitudinal cross-sectional view of a coaxial cable connector comprising a compression ring in accordance with the present invention prior to attachment to the prepared end of a coaxial cable.

FIG. 1 is a longitudinal cross-sectional view of a first embodiment of a coaxial cable connector 10 comprising a compression ring 11 in accordance with the present invention prior to attachment to the prepared end of a coaxial cable and in an uncompressed configuration. The connector 10 comprises a connector nut 12 having a tubular shank 13 extending rearwardly therefrom and a body portion 13 affixed to the connector nut and the tubular shank. An outer shell 15 having a central lumen 16 is slidably attached to the body portion 14 at the leading end thereof. The compression ring 11 of the present invention is removably disposed within the central lumen of the outer shell 15 rearward of the trailing end of the body portion 14.

Figure 2:
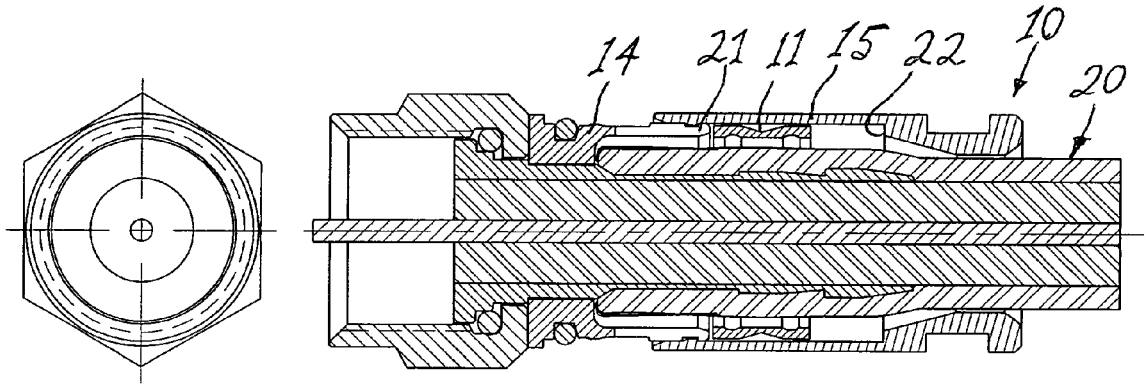
FIG. 2 is a longitudinal cross-sectional view of the coaxial cable connector of FIG. 1 showing the prepared end of a coaxial cable inserted into the axial lumen of the connector prior to attachment of the connector to the cable.

FIG. 2 is a longitudinal cross-sectional view of the coaxial cable connector 10 of FIG. 1 in the uncompressed configuration and showing the prepared end of a coaxial cable 20 inserted into the axial lumen 16 of the connector and fully advanced thereinto prior to attachment of the connector to the cable. The compression ring 11 is loosely held within the central lumen of the outer shell rearward of the trailing end 21 of the body portion 14 and forward of a shoulder 22 within the central lumen 16 of the outer shell 15.

Figure 3:
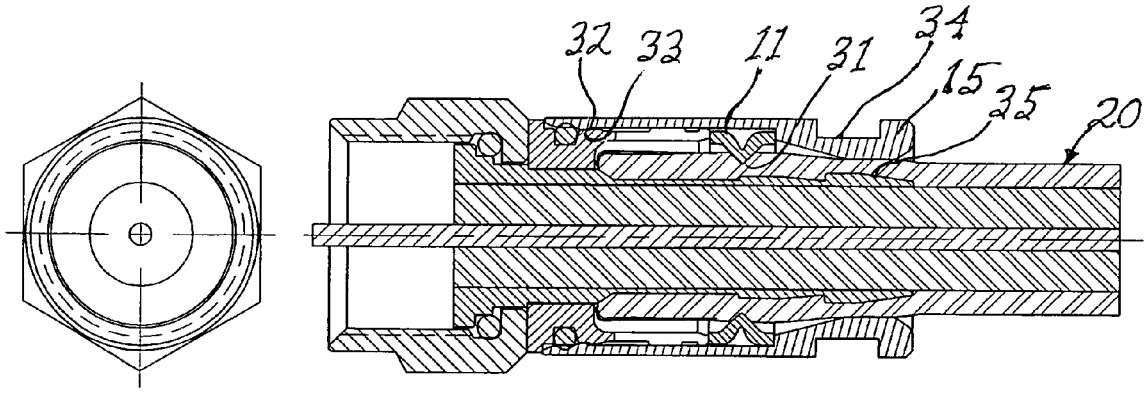
FIG. 3 is a longitudinal cross-sectional view of the coaxial cable connector of FIG. 2 showing the inward deformation of the mid-portion of the compression ring of the present invention after the outer shell is fully advanced over the connector body portion by compression. Left end views are presented at the left of FIGS. 1-3.

FIG. 3 is a longitudinal cross-sectional view of the coaxial cable connector 10 of FIG. 2 showing the inward deformation of the mid-portion of the compression ring 11 of the present invention after the outer shell 15 is fully advanced over the connector body portion 14 by compression. Longitudinal compression of the outer shell 15 causes the compression ring 11 to buckle inwardly at a weakened midportion 31 thereof to securely hold the cable 20 within the central lumen 16 of the connector 10. When the outer shell 15 is fully advanced toward the nut 12, an annular detent ridge 32 on the inner surface of the outer shell 15 matingly engages an annular detent groove 33 on the outer surface of the body portion 14 to lock the outer shell and the body portion together in the position shown in FIG. 3. A ramped portion 34 of the central lumen of the outer shell 15 adjacent the trailing end thereof compresses the cable between the trailing end of the outer shell and a barb 35 disposed on a trailing end of the tubular shank 13. Accordingly, the buckled midportion 31 of the compression ring 11 and the portion of the outer shell 15 rearward of the ramped portion 35 provide two radially symmetric annular compression points against the cable to securely hold the cable within the connector and provide moisture seals.

Figure 4:
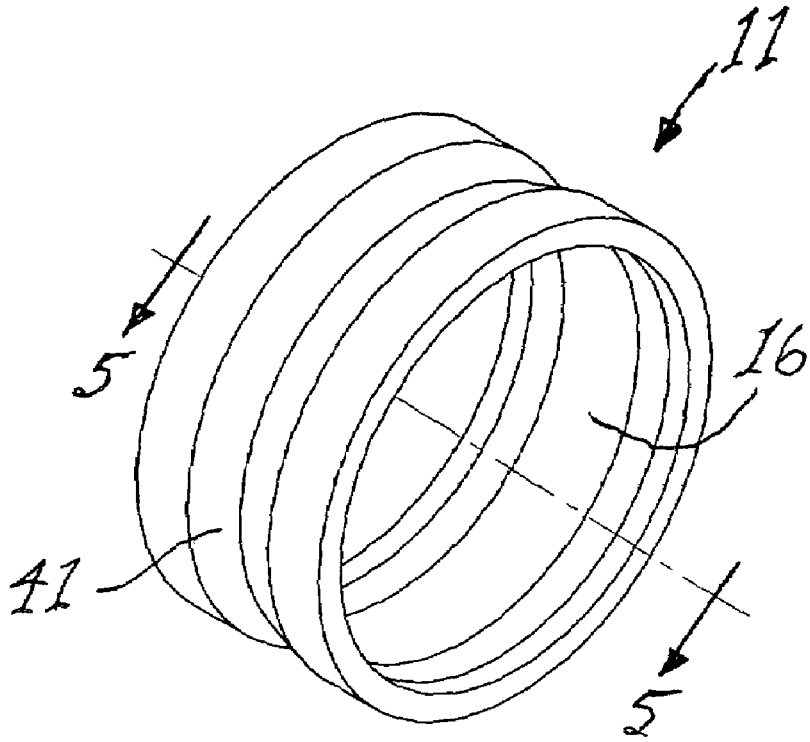
FIG. 4 is a perspective view of a compression ring in accordance with a preferred embodiment of the present invention.
Figure 5:
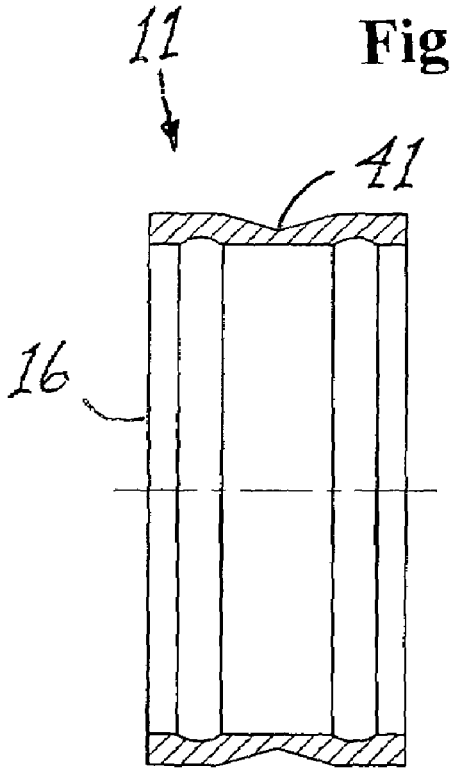
FIG. 5 is a longitudinal cross-sectional view of the compression ring of FIG. 4 taken along section line 5-5.
Figure 6:
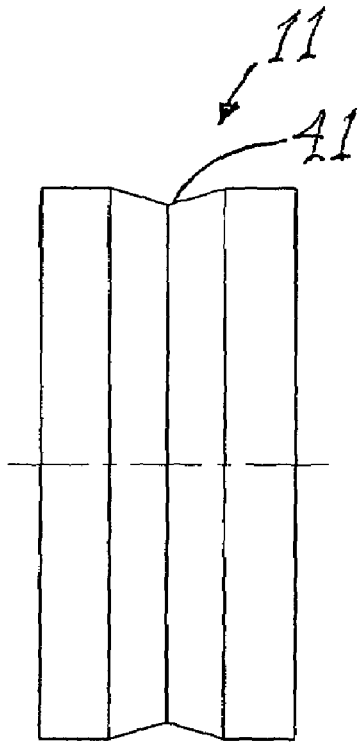
FIG. 6 is a side elevational view of the compression ring of FIGS. 4 and 5.

FIG. 4 is a perspective view of a compression ring 11 in accordance with a preferred embodiment of the present invention. The compression ring 11 has a central lumen 16 and a annular circumferential groove 41 around the outer surface of a midportion thereof. The groove 41 serves to direct the deformation of the ring 11 radially inwardly when longitudinal compression (i.e., a compressive force directed along the axis of symmetry of the ring 11) is applied. The material for making the ring 11 can be either a metal or a plastic. FIG. 5 is a longitudinal cross-sectional view of the compression ring of FIG. 4 taken along section line 5-5. FIG. 6 is a side elevational view of the compression ring of FIGS. 4 and 5.

Figure 7:
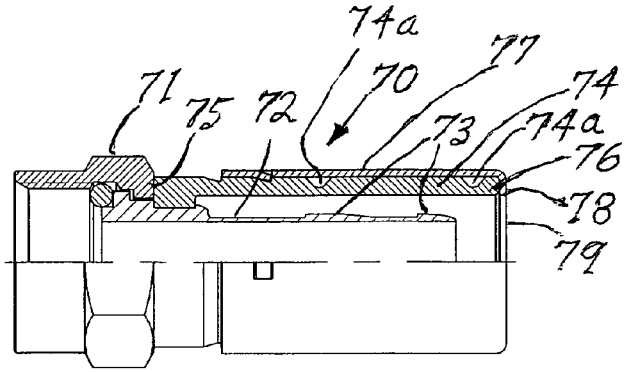
FIG. 7 is a partially cross-sectional side view of a coaxial cable connector in accordance with a second embodiment of the present invention, the connector shown in an open (i.e., noncompressed) position.

FIG. 7 is a partially cross-sectional side view of a coaxial cable connector 70 in accordance with a second embodiment of the present invention. The connector 70 is shown in an open (i.e., noncompressed) position in FIG. 7. The connector 70 has a connector nut 71 on a leading end thereof and a centerpost 72 having a barb(s) 73 thereon. A hard rubber or plastic deformable tubular sleeve 74 has a leading end 75 that abuts the connector nut 71 and a trailing end in opposition thereto and a plurality of annular grooves 74*a* in the outer surface thereof. While the cross-sectional profile of the grooves 74*a* are illustrated as semicylindrical, it is understood that the groove profile can have other shapes such as being "V"-shaped". A rigid, tubular shell 77 is slidable mounted on the outer surface of the sleeve 74. The shell 77 has a recurved trailing end 78 having a circular opening 79 therein, The opening 79 is dimensioned to accommodate the passage of the prepared end of a coaxial cable 90 (FIG. 9) therethrough.

Figure 8:
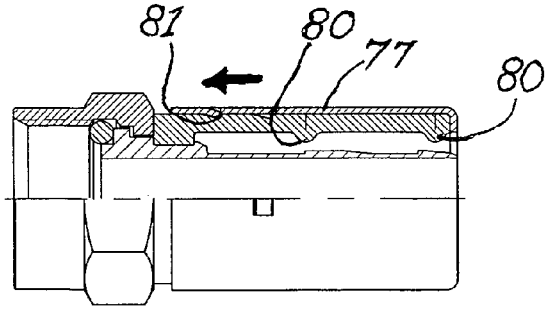
FIG. 8 is a partially cross-sectional view of the coaxial cable connector of FIG. 7 with the deformable plastic sleeve longitudinally compressed by the overlying rigid shell which has been fully advanced over the sleeve and locked in position.

FIG. 8 is a partially cross-sectional view of the coaxial cable connector of FIG. 7 with the deformable plastic sleeve 74 longitudinally compressed and deformed inwardly by the overlying rigid shell 77 which has been fully advanced over the sleeve 74 in the direction of the arrow and locked in position by detent 81. The shell limits the outward deformation of the sleeve during longitudinal compression thereof. The grooves 74*a* close during compression thereby uniformly deforming a band of the sleeve material underlying the grooves radially inwardly to form protrusions 80. In this regard, the inner cable-facing surface of the axial bore in the sleeve 74 may have annular slits or grooves thereon to provide a protrusion 80 having a particular shape.

Figure 9:
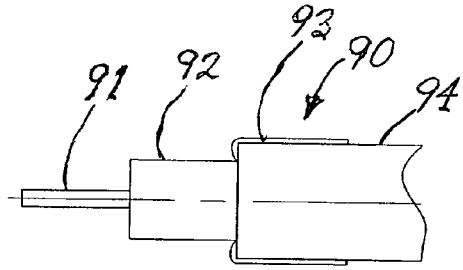
FIG. 9 is a side view of the prepared end of a coaxial cable prior to insertion into a connector in accordance with FIG. 7.

FIG. 9 is a side view of the prepared end of a coaxial cable prior to insertion into a connector in accordance with FIG. 7. The coaxial cable 90 has a center conductor 91 surrounded by a dielectric layer 92. A layer of braided conductive shielding 93 overlies the dielectric layer and an end portion of the shielding is folded back over a jacket 94 in preparation for attachment of the prepared end into a coaxial cable connector 70.

Figure 10:
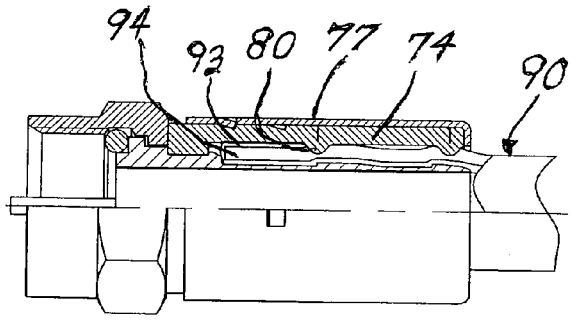
FIG. 10 is a partially cross-sectional view of the coaxial cable connector of FIG. 7 with the cable inserted into the axial bore in the connector body and the deformable plastic sleeve longitudinally compressed by the overlying rigid shell which has been fully advanced over the sleeve and locked in position.

FIG. 10 is a partially cross-sectional view of the coaxial cable connector 10 of FIG. 7 with the cable inserted into the axial bore in the connector and the deformable plastic sleeve 74 longitudinally compressed by the overlying rigid shell 77 which has been fully advanced over the sleeve and locked in position as shown in FIG. 8. The protrusions 80 press against the braided shielding and jacket of the cable against the centerpost to effectively secure the cable to the connector.

The second embodiment of a compression connector for a coaxial cable described discloses a connector comprising a plastic inner sleeve extending rearwardly from a connector nut, the sleeve having annular compression grooves, and a rigid, tubular outer shell slidably mounted over the sleeve. When the outer shell is compressed longitudinally, the deformable plastic sleeve also longitudinally compresses resulting in inwardly protruding radial bands which compress the coaxial cable between the radial bands and the center post. Using a plastic inner sleeve allows for consistent low force compression due to the presence of the rigid outer shell which constrains the deformation of the sleeve radially inwardly and provides support and protection for the cable and connector. The rigid outer shell acts as a guide during compression to insure the plastic inner body deforms inwardly in a uniform manner, even if the longitudinal force is slightly uneven. The present invention reduces manufacturing and installation difficulties and provides a lower cost product. In addition, both the first and second embodiments disclosed herein provide a moisture seal between the body portion (or sleeve) of the connector and the cable securely held therewithin.

While particular embodiments of the present invention have been illustrated and described, it would be obvious to those skilled in the art that various other changes and modifications can be made without departing from the spirit and scope of the invention. For example, it is a principle feature of both embodiments of the present invention described hereinabove that tapering of the axial bore of the outer rigid shell and/or the body portion (or sleeve) is not required to provide inward deformation of the compressive member. Only a longitudinal force applied to the shell is required for radially sealing the cable within the connector. The absence of tapered axial bores and/or tapered outer surfaces in the shell, compression ring and body portions distinguishes the present connectors from prior art connectors. It is therefore intended to cover in the appended claims all such changes and modifications that are within the scope of this invention.

What I claim is:

1. A coaxial cable connector comprising a connector nut, a tubular shank extending rearwardly from said connector nut, a tubular body portion having a leading end abutting said connector nut and a trailing end in opposition thereto, said tubular body portion concentrically overlying said tubular shank, a tubular outer shell having a leading end, a trailing end and an axial bore with an abruptly reduced inner diameter defining a shoulder therewithin disposed rearward of said leading end of said shell, said leading end of said tubular shell being slidingly attached to a trailing end of said body portion, and a compression ring removably disposed within said axial bore of said shell rearward of trailing end of said body portion and forward of said shoulder, said compression ring comprising a tubular member having a leading end, a trailing end and a cylindrical outer surface with a circumferential annular groove on said cylindrical outer surface.

2. The coaxial cable connector of claim 1 wherein said axial bore of said shell is tapered conically inwardly rearward of said shoulder and forward of said trailing end thereof.

3. In a compression-type coaxial cable connector comprising a connector nut, a tubular shank defining a centerpost having a leading end attached to said connector nut and a trailing end extending rearwardly from said connector nut, a tubular sleeve overlying said centerpost, said tubular sleeve having a leading end abutting said connector nut and a trailing end and a body portion therebetween, and a rigid tubular shell slidably mounted on said trailing end of said tubular sleeve, said rigid tubular shell having a cylindrical axial bore with an abruptly reduced inner diameter at a trailing end thereof defining a shoulder, the improvement wherein said tubular sleeve is an elastically deformable tubular member having an annular groove in an outer surface thereof and wherein when said shoulder is forced against said trailing end of said sleeve, a portion of said sleeve underlying said groove deforms radially inwardly inwardly to press against a cable housed within said axial bore of said sleeve.

4. The compression-type coaxial cable connector of claim 3 wherein said outer surface of said sleeve has a plurality of annular grooves thereon.

5. The coaxial cable connector of claim 3 wherein said shell is made from a rigid, substantially nondeformable material and wherein when said shell is moved toward said connector nut, said shoulder in said shell is urged against said trailing end of said tubular sleeve and said sleeve is longitudinally compressed such that an annular portion of said sleeve underlying said groove is forced radially inwardly.

6. The coaxial cable connector of claim 3 wherein said tubular sleeve is made from rubber.

* * * * *